US010264874B2

(12) United States Patent
Becker

(10) Patent No.: US 10,264,874 B2
(45) Date of Patent: Apr. 23, 2019

(54) LOADOUT EXCHANGE SYSTEM

(71) Applicant: AARDVARK, LaVerne, CA (US)

(72) Inventor: Jonathan B. Becker, LaVerne, CA (US)

(73) Assignee: AARDVARK, Laverne, CA (US)

( * ) Notice: Subject to any disclaimer, the term of this patent is extended or adjusted under 35 U.S.C. 154(b) by 81 days.

(21) Appl. No.: 15/701,925

(22) Filed: Sep. 12, 2017

(65) Prior Publication Data

US 2019/0075916 A1 Mar. 14, 2019

(51) Int. Cl.
*A45F 5/02* (2006.01)
*A45F 3/14* (2006.01)

(52) U.S. Cl.
CPC ..... *A45F 5/02* (2013.01); *A45F 3/14* (2013.01); *A41D 2400/48* (2013.01)

(58) Field of Classification Search
CPC ..... A45F 5/02; A45F 3/14; A41D 2400/48
USPC ..... 224/675
See application file for complete search history.

(56) References Cited

U.S. PATENT DOCUMENTS 5,465,425 A * 11/1995 Crispin ..... A41D 13/0012 2/102
5,724,707 A * 3/1998 Kirk ..... A41D 13/0012 2/102
7,047,570 B2 * 5/2006 Johnson ..... F41H 1/02 2/102
7,694,862 B2 * 4/2010 Bergeron ..... A45F 5/02 224/665
7,814,567 B2 * 10/2010 Dovner ..... F41H 1/02 2/2.5
7,963,427 B2 * 6/2011 Calkin ..... A41D 13/0012 224/675
8,002,159 B2 * 8/2011 Cragg ..... A45F 5/02 224/579
8,209,825 B2 * 7/2012 Carter ..... C07H 1/06 24/606
8,490,212 B1 * 7/2013 Asher ..... A41D 1/04 2/2.5
8,572,762 B2 * 11/2013 Herbener ..... F41H 1/02 2/2.5
8,720,762 B2 * 5/2014 Hilliard ..... F42B 39/02 224/675
8,826,462 B2 * 9/2014 Storms, Jr. ..... A41D 1/04 2/2.5
9,521,897 B2 * 12/2016 Thompson ..... A45F 5/02
9,565,922 B2 * 2/2017 Cole ..... A45F 5/02
10,010,160 B1 * 7/2018 Ostrowski ..... A41D 31/0005
(Continued)

*Primary Examiner* — Justin M Larson
*Assistant Examiner* — Lester L Vanterpool
(74) *Attorney, Agent, or Firm* — Vista IP Law Group LLP

(57) ABSTRACT

A loadout exchange system includes a back panel and a front panel. The back panel has a front side with a hook and loop surface, a back side with a MOLLE-compatible surface, one or more tab locks, and one or more straps. The front panel has a front side with a MOLLE-compatible surface, a back side with a hook and loop surface, one or more pull tabs, and one or more tuck tabs with a hook and loop surface. The front surface of the back panel and the back surface of the front panel are complimentary and thus configured to mate with each other to be removably secured to each other. The tab locks and pull tabs also have complimentary hook and loop surfaces and are thus configured to mate with each other to be removably secured to each other.

20 Claims, 13 Drawing Sheets

(56) References Cited

U.S. PATENT DOCUMENTS

| | | | | |
|---|---|---|---|---|
| 10,053,803 | B2 * | 8/2018 | Thompson | A41D 31/0005 |
| 2010/0025560 | A1 * | 2/2010 | Beck | A45F 5/02<br>248/558 |
| 2011/0191933 | A1 * | 8/2011 | Gregory | A41D 13/0012<br>2/69 |
| 2015/0189977 | A1 * | 7/2015 | Thompson | A45F 5/02<br>24/3.7 |
| 2017/0307335 | A1 * | 10/2017 | Skifstad | F41H 1/02 |

* cited by examiner

LOADOUT EXCHANGE SYSTEM

TERMINOLOGY

"PALS" as used herein is a well-known acronym for "Pouch Attachment Ladder System." PALS webbing is used on backpacks, rucksacks, and the like. "MOLLE" as used herein is a well-known acronym for "Modular Lightweight Load-carrying Equipment," and often uses PALS webbing. For a more detailed description of PALS webbing and MOLLE-compatible systems, see the Background section of U.S. Pat. No. 9,521,897, and see U.S. Pat. No. 5,724,707, referred to therein.

"Hook and loop" as used herein means traditional hook and loop such as VELCRO, as well as other similar touch fasteners such as 3M's DUAL LOCK fasteners.

"Loadout" as used herein refers to various equipment such as flashlights, firearms, firearm magazines, holsters, ammunition, Tasers, flash-bang devices, knives, rope, radios, medical gear, manuals, communication equipment, and the like, that are typically carried by military personnel, law enforcement, firefighters, paramedics, search and rescue personnel, hikers, and other outdoor adventurers in MOLLE pouches.

BACKGROUND

Loadouts are typically secured in MOLLE-compatible pouches that are then attached to a MOLLE-compatible load-bearing platform such as a vest, rucksack, backpack, or the like. While MOLLE-compatible systems generally secure the equipment quite well to the load-bearing platform, doing so requires a substantial amount of time to weave straps from the pouch alternately between straps or slots on the load-bearing platform. This must be done each time a pouch is exchanged (i.e., added to, removed from, or relocated on the platform). There is thus a need for a MOLLE-compatible system that allows exchange of a loadout without having to un-weave and/or re-weave the pouch straps from/to the load-bearing platform, and also that securely supports heavy loads.

SUMMARY OF THE INVENTION

One aspect of the present invention includes a back panel in which the back of the back panel is MOLLE-compatible to be secured to a MOLLE-compatible load-bearing platform, and the front of the back panel has a hook and loop surface.

Another aspect includes a back panel and a front panel, in which the back of the back panel is MOLLE-compatible to be secured to a MOLLE-compatible load-bearing platform, the front of the front panel is MOLLE-compatible to receive and secure one or more MOLLE pouches, and the front of the back panel and back of the front panel are removably securable to each other using complimentary hook and loop surfaces.

Another aspect includes a back panel and hook and loop loadout pouch, in which the back of the back panel is MOLLE-compatible to be secured to a MOLLE-compatible load-bearing platform, and the front of the back panel and back of the hook and loop loadout pouch are removably securable to each other using complimentary hook and loop surfaces.

Another aspect includes tuck tabs on the front panel having hook and loop surfaces that are complimentary to hook and loop surfaces of corresponding tab locks on the back panel.

Another aspect includes one or more pull tabs on the front panel to facilitate removal of the front panel from the back panel, with or without a MOLLE pouch attached to the front panel.

Another aspect includes securing the back of the back panel to a MOLLE-compatible load-bearing platform, securing one or more MOLLE pouches to the front of the front panel, securing the back of the front panel to the front of the back panel using mating hook and loop surfaces, and further securing the front panel to the back panel using mating tuck tabs and tab locks.

The present invention thus provides a loadout exchange system that allows for secure placement of MOLLE pouches to MOLLE-compatible load-bearing surfaces, and for exchange of the pouches, without having to un-weave and/or re-weave the pouch straps from/to the load-bearing platform.

DRAWINGS

DETAILED DESCRIPTION

Figure 14A:
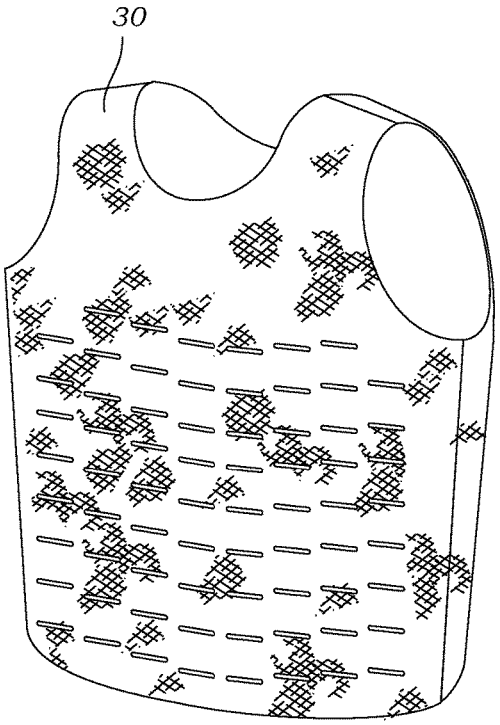
Fig. 14A (Prior Art)
FIG. 14A shows a prior art webless MOLLE-compatible load-bearing platform.
Figure 14B:
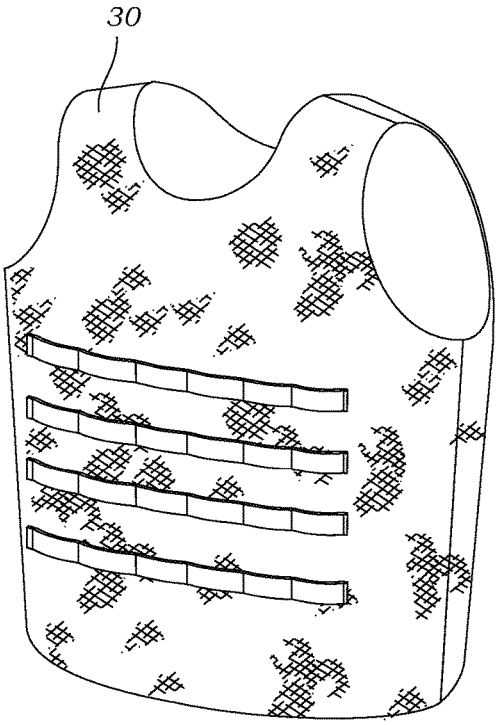
Fig. 14B (Prior Art)
FIG. 14B shows a prior art traditional (webbed) MOLLE-compatible load-bearing platform.

The present invention relates to a loadout exchange system (5) for use with state of the art MOLLE-compatible gear. The system (5) allows exchange of a loadout (10) without having to un-weave and/or re-weave pouch straps of a MOLLE pouch (25) from/to the MOLLE-compatible load-bearing platform (30), as is required with state of the art MOLLE-compatible gear. The system (5) also securely supports heavy loadouts. MOLLE-compatible gear may be slotted (i.e., webless as seen in FIG. 14A) or traditional (i.e., webbed as seen in FIG. 14B).

Figure 1:
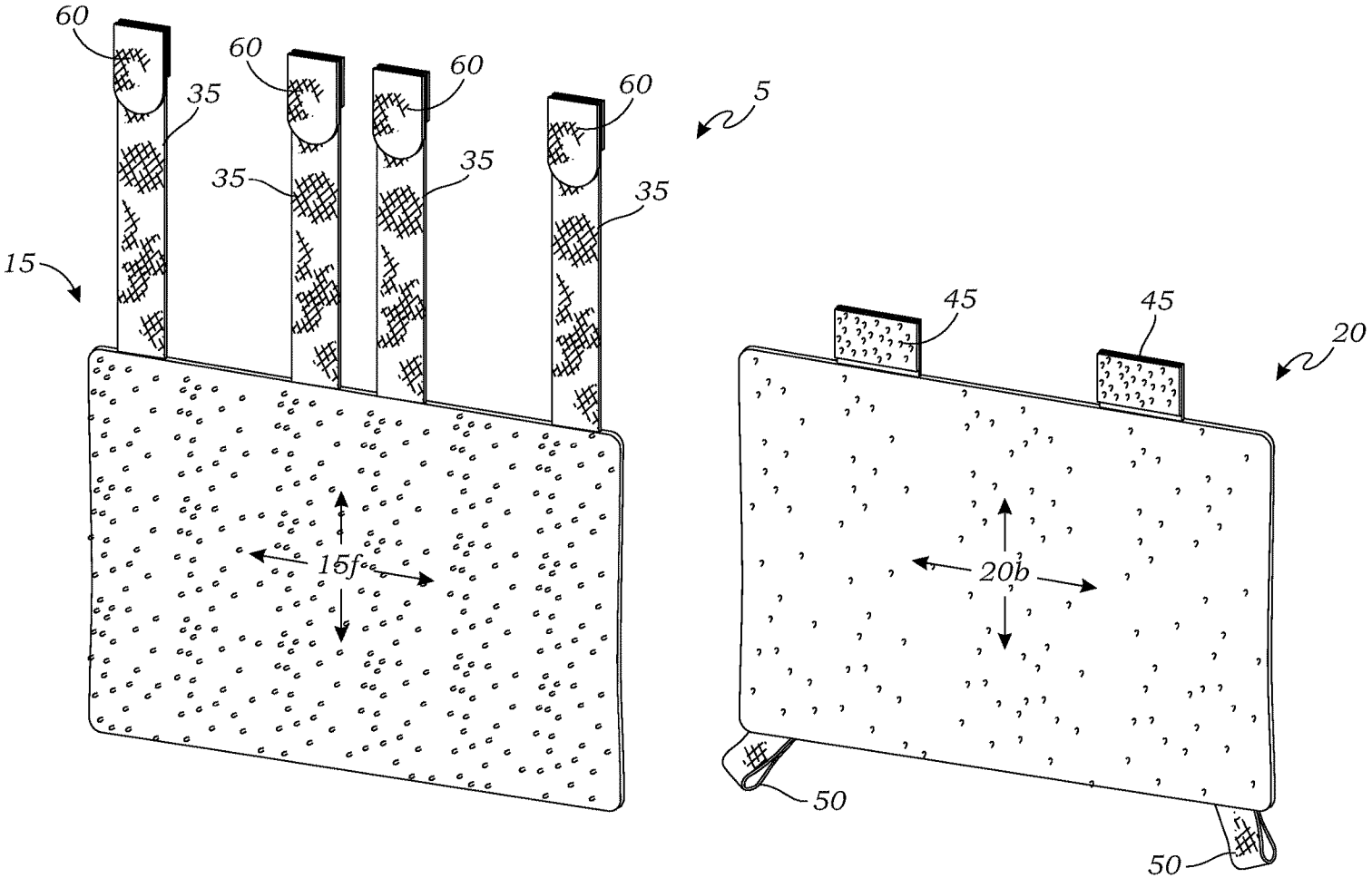
FIG. 1 shows a front perspective view of a back panel and a back perspective view of a front panel in accordance with an embodiment of the present invention.
Figure 2:
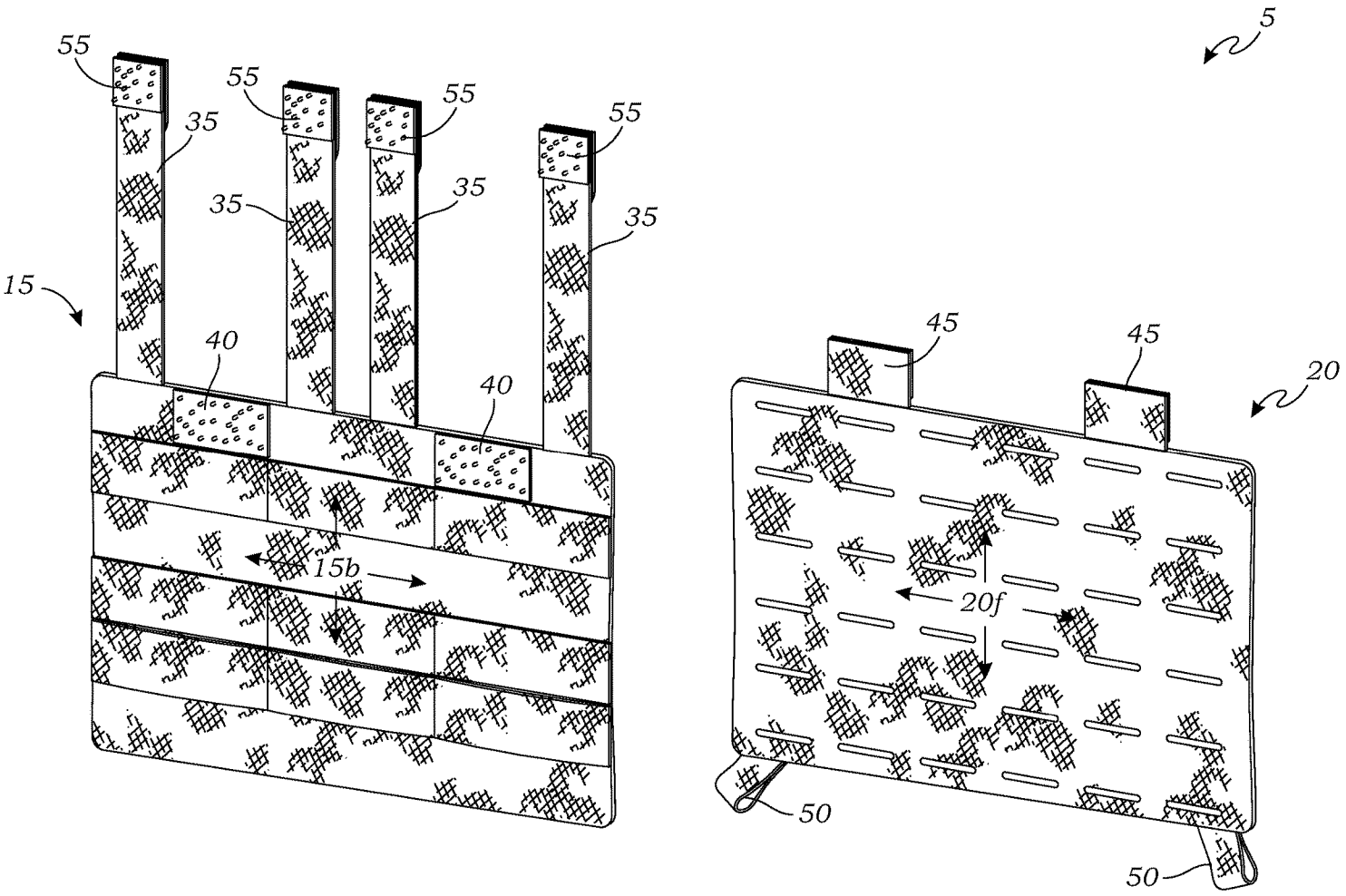
FIG. 2 shows a back perspective view of the back panel of FIG. 1, and a front perspective view of the front panel of FIG. 1.
Figure 12:
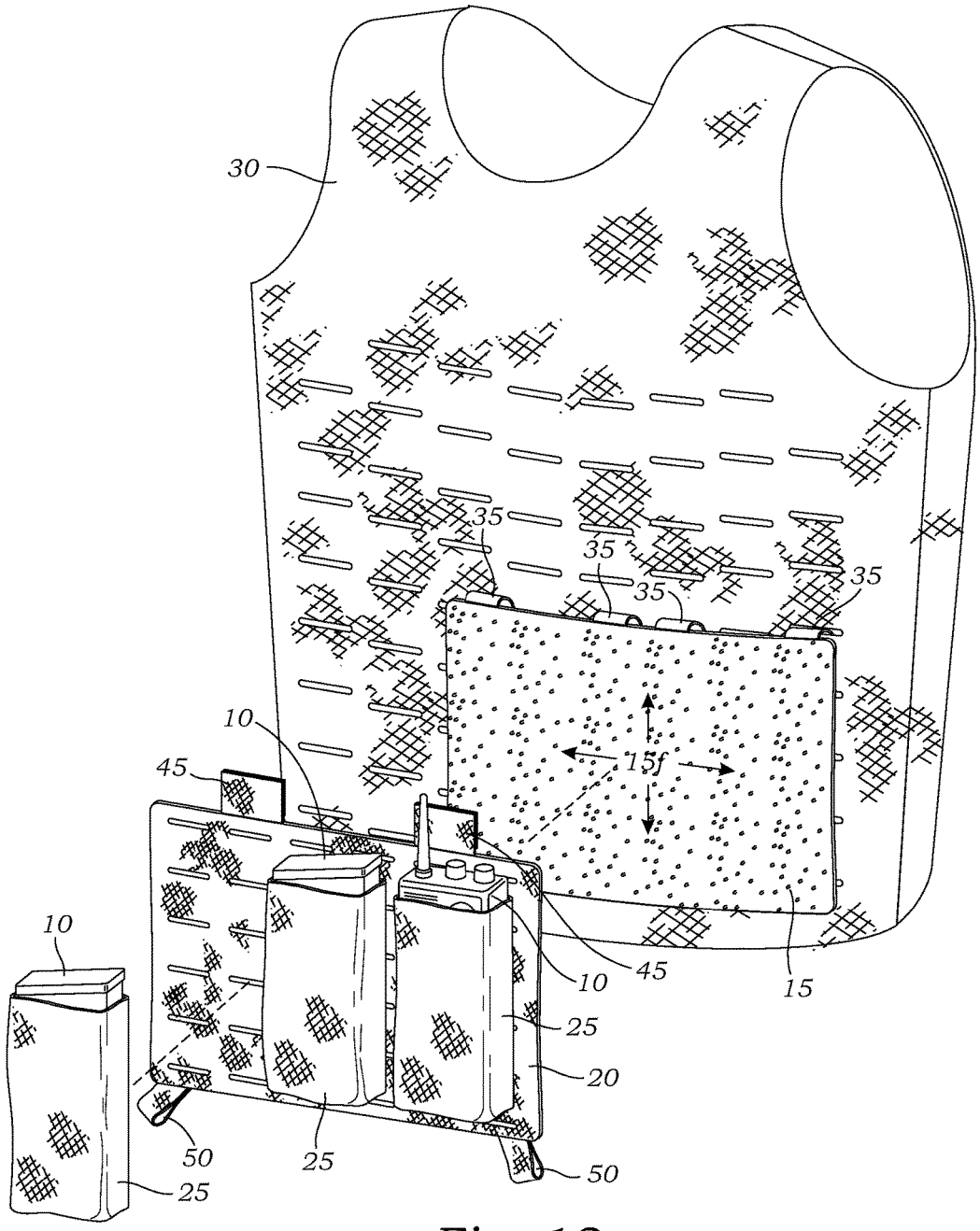
FIG. 12 shows the back panel of FIG. 1 secured to the MOLLE-compatible load-bearing platform of FIG. 7, and the front panel of FIG. 2 positioned to be secured to the back panel (similar to FIG. 8, except with loadouts secured to the front panel).
Figure 13:
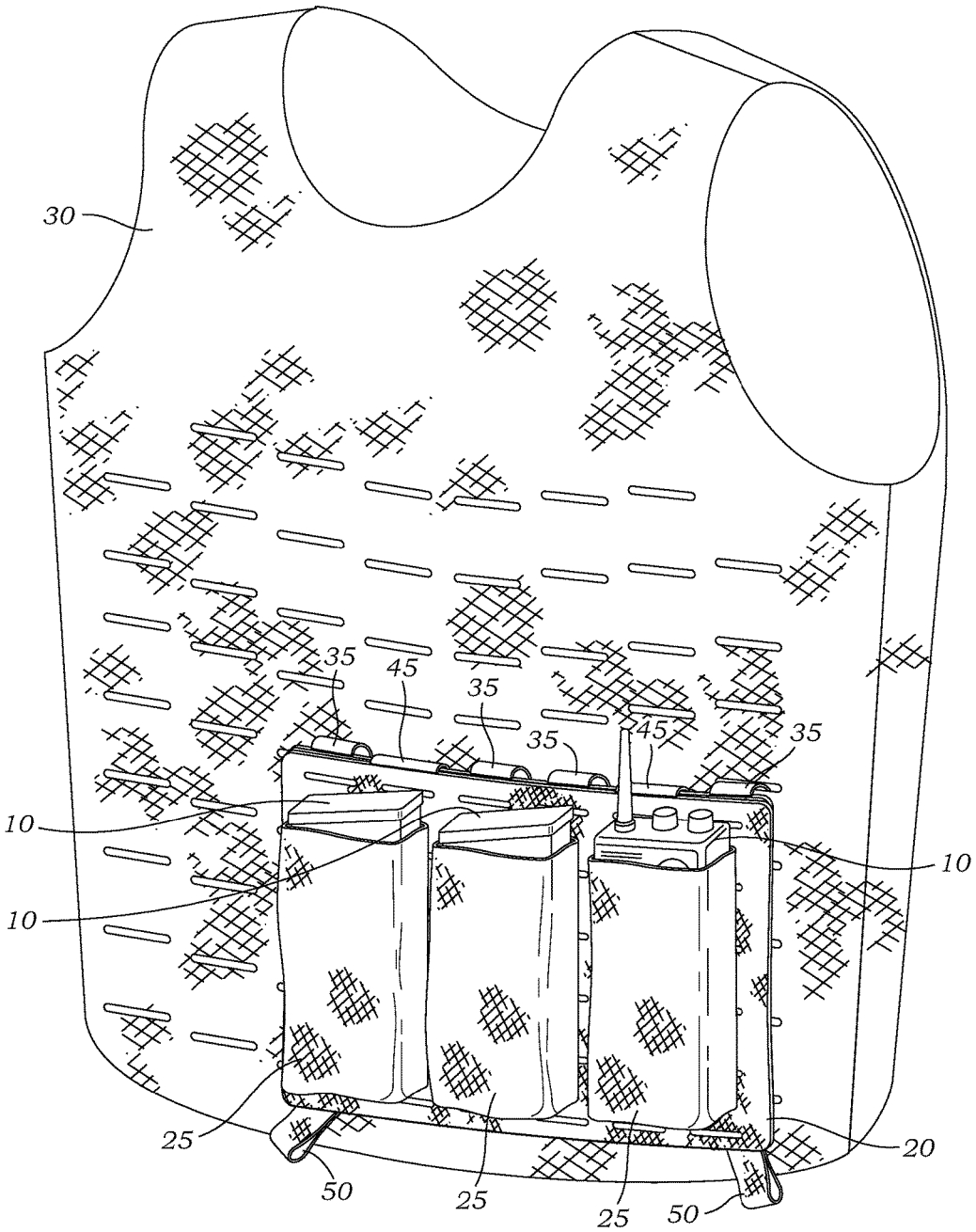
FIG. 13 shows the back panel of FIG. 1 secured to the MOLLE-compatible load-bearing platform of FIG. 7, and the front panel of FIG. 2 secured to the back panel (similar to FIG. 9, except with loadouts secured to the front panel).

Turning to FIGS. 1-2, a loadout exchange system (5) of the present invention is shown, which includes a back panel (15) and a front panel (20). FIG. 1 shows the front side (15*f*) of the back panel (15) and the back side (20*b*) of the front panel (20), whereas FIG. 2 shows the back side (15*b*) of the back panel (15) and the front side (20*f*) of the front panel (20). The panels (15, 20) may comprise canvas, nylon, rubber, elastic or other suitable materials as is known in the art of MOLLE systems. Both the back side (15*b*) of the back panel (15), and the front side (20*f*) of the front panel (20), are MOLLE-compatible. The back side (15*b*) of the back panel (15) is illustrated with a traditional MOLLE-compatible surface, and the front side (20*f*) of the front panel (20) is illustrated with a webless MOLLE-compatible surface, but traditional or webless may be used for either panel (15, 20). In use, the back side (15*b*) of the back panel (15) is attached to a MOLLE-compatible load-bearing platform (30) such as a vest using the straps (35), and MOLLE pouches (25) containing the loadouts (10) are attached to the front side (20*f*) of the front panel (20) using straps of the MOLLE pouches (25). This is illustrated in FIG. 12 and FIG. 13. The front panel (20) is secured to the back panel (15) by placing the back side (20*b*) of the front panel (20) over he front side (15*f*) of the back panel (15) as more fully described herein.

The front side (15*f*) of the back panel (15) and the back side (20*b*) of the front panel (20) comprise complementary hook and loop surfaces. The drawings show the front side (15*f*) of the back panel (15) with a loop surface, and the back side (20*b*) of the front panel (20) with a hook surface, but such surfaces are interchangeable so long as they are complimentary. The front side (15*f*) of the back panel (15) may be attached to the back side (15*b*) of the back panel (15) by glue, stitching, and/or staples, or any other suitable means. The back side (20*b*) of the front panel (20) may be attached to the front side (20*f*) of the front panel (20) similarly.

The back panel (15) comprises one or more straps (35) to straps on state of the art MOLLE pouches (25). The straps (35) are used to attach the back side (15*b*) of the back panel (15) to a MOLLE-compatible load-bearing platform (30) similar to how straps on a state of the art MOLLE pouch (25) would be used to attach the MOLLE pouch (25) to the load-bearing platform (30).

The back side (15*b*) of the back panel (15) also has one or more tab locks (40) with a hook and loop surface for mating with complimentary hook and loop surfaces of one or more corresponding tuck tabs (45) on the front panel (20). The tab locks (40) may be attached to the back side (15*b*) of the back panel (15) by glue, stitching, staples, or any other suitable means. There are two tab locks (40) shown in the drawings, positioned along the upper edge of the back panel (15). However, the quantity, shape, size, position, and orientation of tab locks (40) may vary as needed. For example, there may be 1, 2, 3, 4, 5, 6, 7, 8, 9, 10, or more tab locks (40). They may be square-shaped, rectangular, circular, star-shaped, oblong, triangular, or any other shape. They may be positioned along the bottom edge, sides, and/or corners. They may contain more or less surface area than the corresponding tuck tabs (45) with which they are configured to mate.

The front panel (20) has one or more tuck tabs (45) with hook and loop surfaces. The tuck tabs (45) are positioned and configured to mate with complimentary hook and loop surfaces of the corresponding tab locks (40) on the back panel (15). For example, as shown in the drawings, there are two tuck tabs (45) positioned along the upper edge of the front panel (20), corresponding to the positions of the two tab locks (40) on the back panel (15). Once the front panel (20) is positioned over the back panel (15) as described herein, the tuck tabs (45) may then be folded over the back panel to engage the tab locks (40) for further securing the front panel (20) to the back panel (15). Doing so has been shown to dramatically reduce unwanted movement of the loadouts (10) when the loadout exchange system (5) is in use. For example, using a loadout exchange system (5) of the present invention secured to a load-bearing platform (30) such as a tactical vest, with the tab locks (40) and tuck tabs (45) disengaged, may result in the vest and accompanying loadouts (10) bouncing and/or swaying to an unacceptable degree during physical activity such as running or jumping. With the tab locks (40) engaged with the tuck tabs (45), however, the front panel (20) is further secured to the back panel (15) to significantly limit such unwanted movement, even for relatively heavy loadouts, such as approximately 5 pounds or more.

Figure 11:
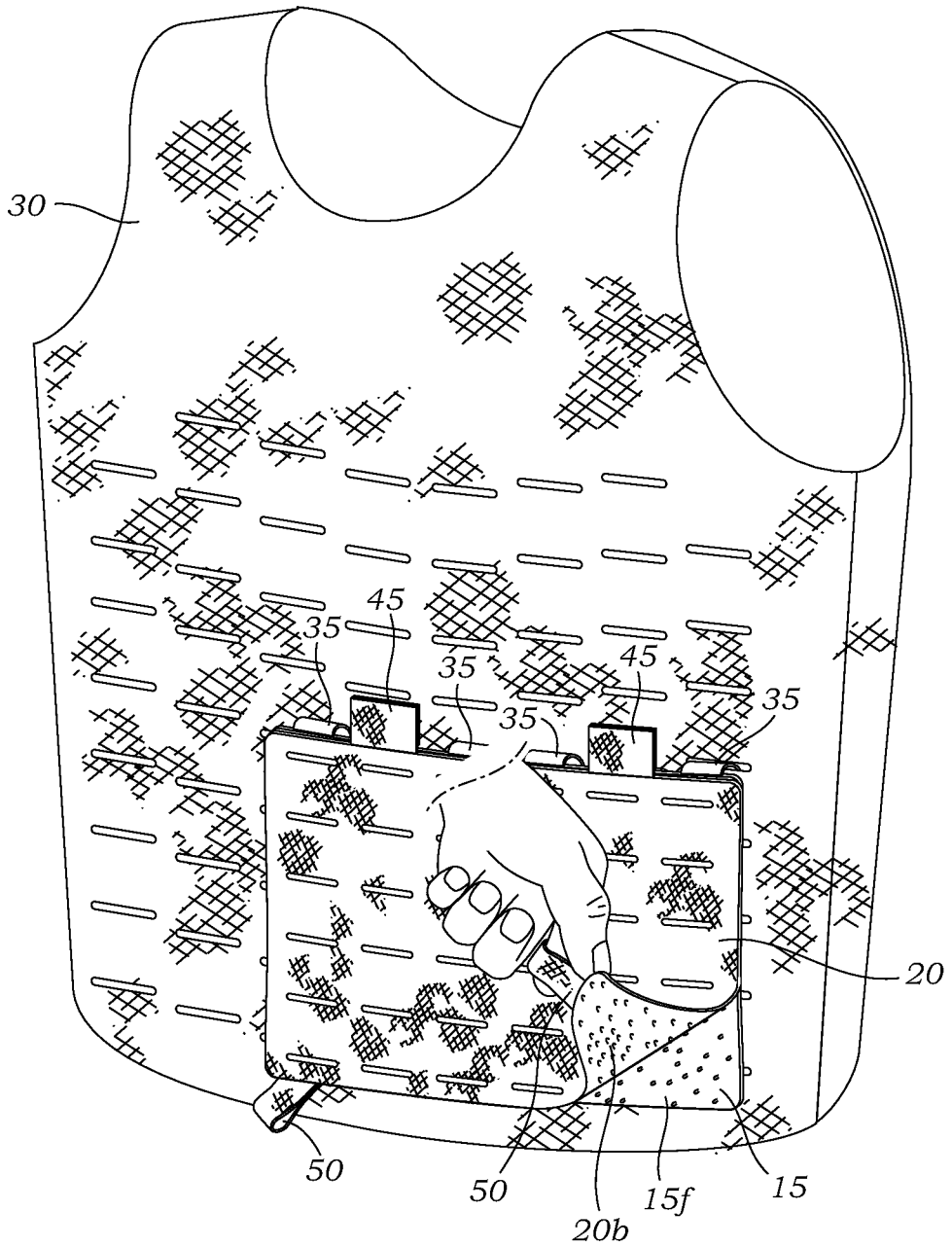
FIG. 11 shows the loadout exchange system of FIG. 9, with the front panel being removed from the back panel via a pull tab.

The front panel (20) also includes one or more pull tabs (50). The drawings show two pull tabs (50), one positioned at the lower right corner of the front panel (20), and the other positioned at the lower left corner of the front panel (20). However, pull tabs (50) may be positioned at various locations as needed, including along the sides and/or bottom edge of the front panel (20). For smaller front panels (20), a single pull tab (50) may be sufficient, and may be positioned as needed including centered along the bottom edge of the front panel (20). The pull tabs (50) shown are at the corners, and positioned at an angle to facilitate removal of the front panel (20) from the back panel (15) by pulling one of the pull tabs (50) along its longitudinal axis. For example, as seen in FIG. 11, the pulling direction for the pull tab (50) at the lower right corner of the front panel (20) is at a diagonal across the front panel (20) from lower right to upper left. Likewise, the pulling direction for the pull tab (50) at the lower left corner of the front panel (20) would be at a diagonal across the front panel (20) from lower left to upper right. The pull tabs (50) may be weighted, indented, taped, textured, or have other features to maximize grip. For example, as shown in the drawings, the pull tabs (50) are looped. They may also be colored for fast visual identification.

Figure 4:
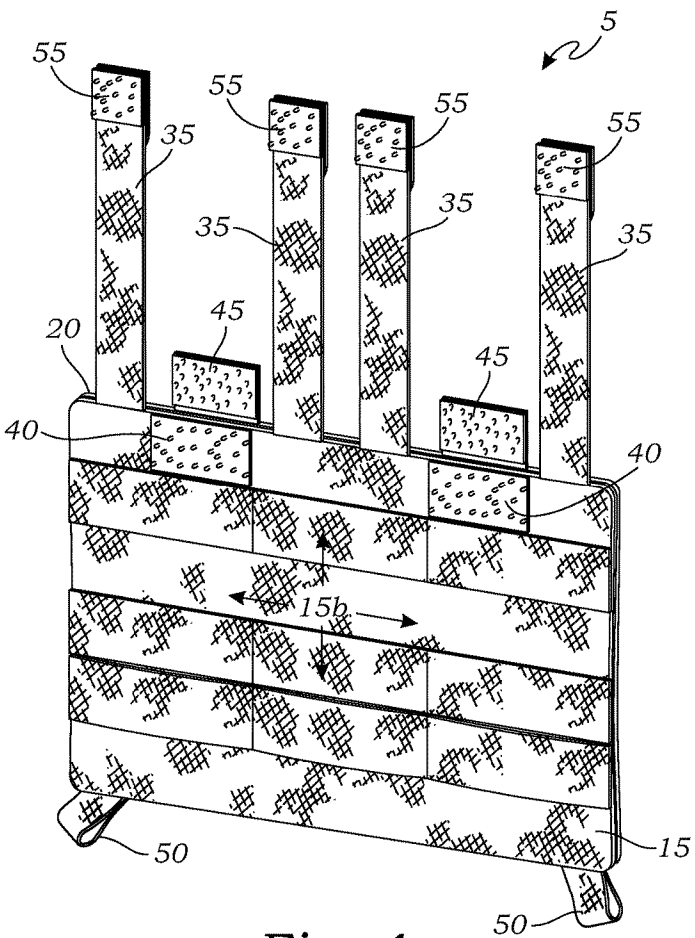
FIG. 4 shows a back perspective view of the loadout exchange system of FIG. 3.
Figure 3:
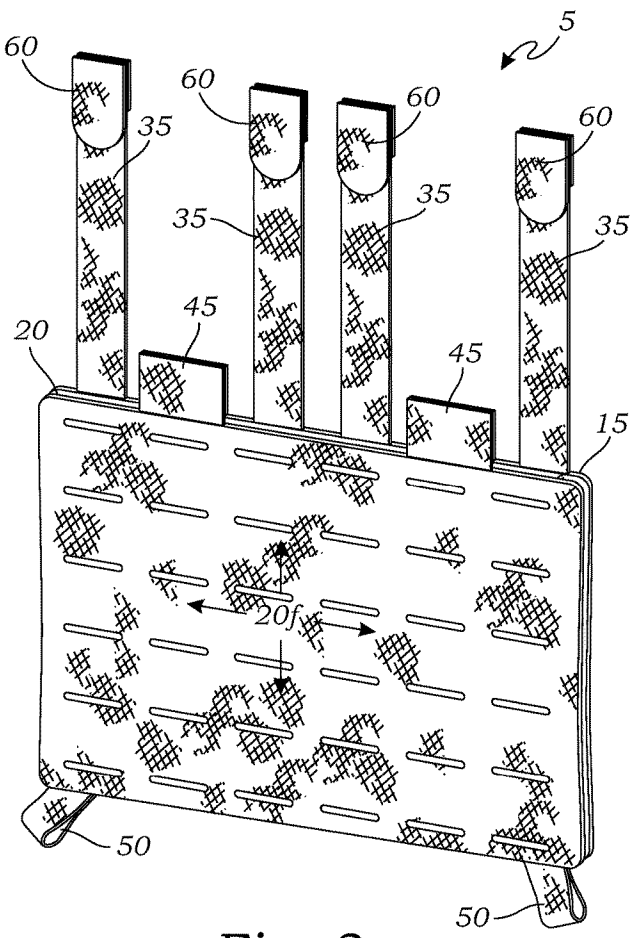
FIG. 3 shows a front perspective view of a loadout exchange system in accordance with an embodiment of the present invention, with the front panel of FIG. 1 aligned atop the back panel of FIG. 1.
Figure 6:
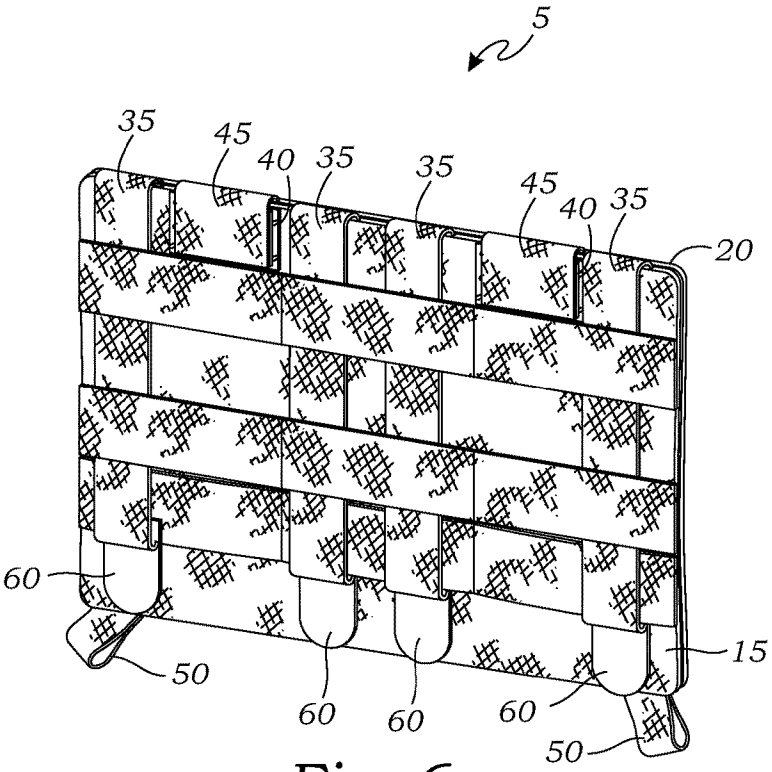
FIG. 6 shows the loadout exchange system of FIG. 4 with the tuck tabs folded over an edge of the back panel, and the straps weaved through the MOLLE webbing of the back panel and secured under one of the webs.
Figure 5:
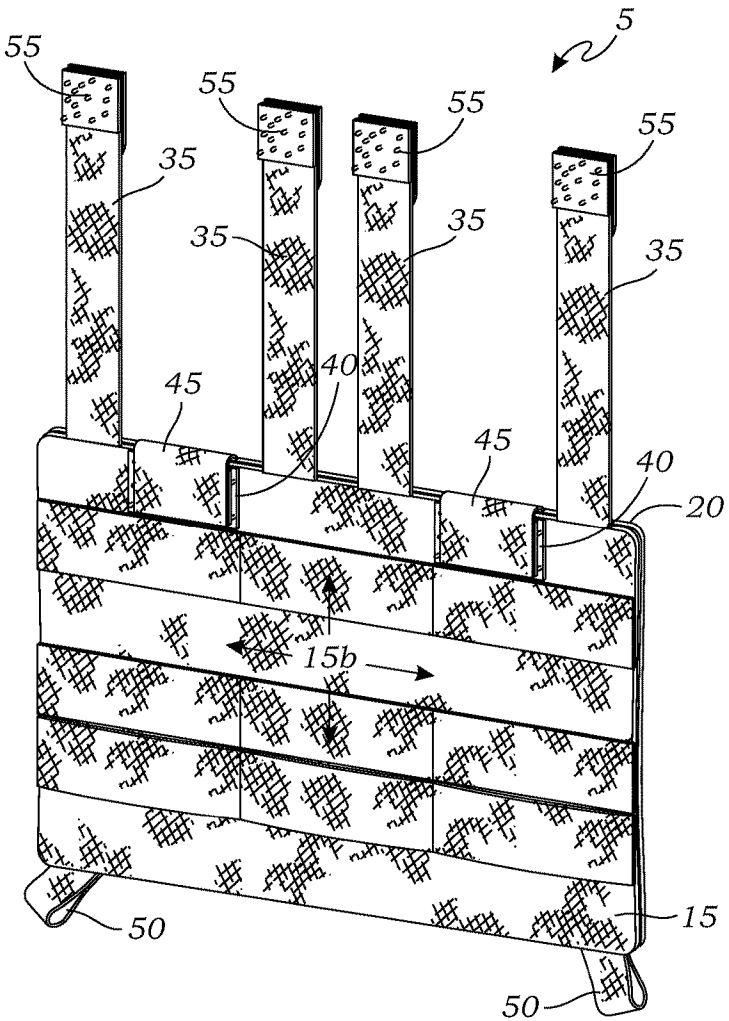
FIG. 5 shows the loadout exchange system of FIG. 4 with the tuck tabs folded over an edge of the back panel.

Turning to FIGS. 3-4, FIG. 3 shows a front perspective view of a loadout exchange system (5) in accordance with an embodiment of the present invention, with the front panel (20) aligned atop the back panel (15) and removably secured thereto by the mating hook and loop surfaces on the front side (15*f*) of back panel (15) and the back side (20*b*) of front panel (20), FIG. 4 shows the back perspective view of the loadout exchange system (5) as seen in FIG. 3. In FIGS. 3-4, the tuck tabs (45) are not yet engaged with the tab locks (40). FIG. 5 shows the loadout exchange system (5) of FIG. 4 with the tuck tabs (45) folded over the upper edge of the back panel (15) such that the hook and loop surface of the tuck tabs (45) mate with the hook and loop surfaces of the tab locks (40) to removably secure the tuck tabs (45) to the tab locks (40). FIG. 6 shows the same loadout exchange system (5) with the straps (35) weaved through the MOLLE webbing on the back side (15*b*) of the back panel (15) and secured under the last web by hook and loop surfaces (55) on the ends of the straps (35) mating with complimentary hook and loop surfaces (not shown) under the last web. When attached to a MOLLE-compatible load-bearing platform (30), the straps (35) would be weaved alternately between the webs (or webless slots) of the platform (30) and the webs (or webless slots) of the back side (15*b*) of the back panel (15). The straps (35) may also have pull tabs (60) for facilitating removal or repositioning of the straps from or within the MOLLE webs (or webless slots as the case may be), and may be secured at or under the last web or slot using snaps or other means instead of or in addition to the hook and loop surfaces (55).

Figure 7:
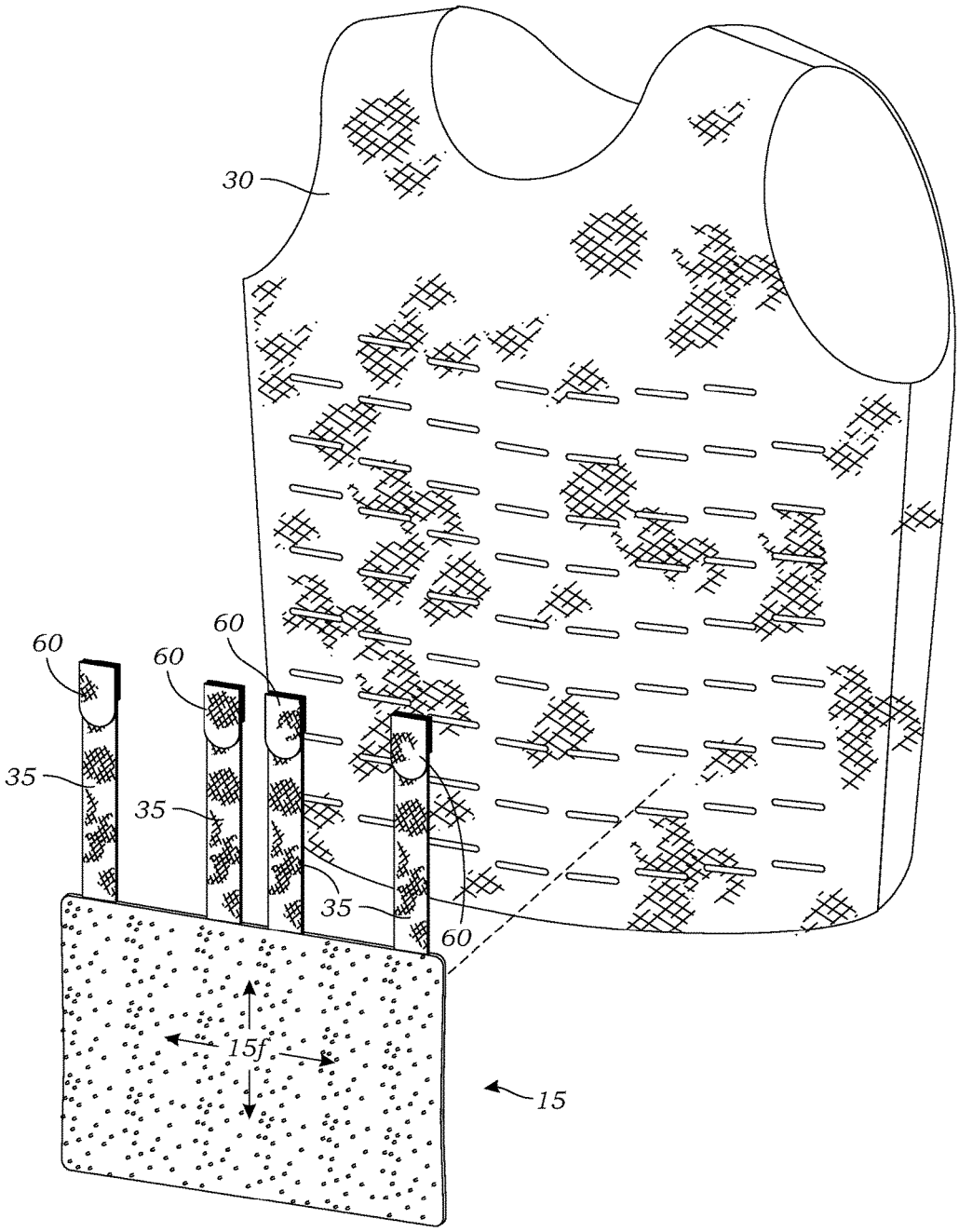
FIG. 7 shows the back panel of FIG. 1 positioned to be secured to a MOLLE-compatible load-bearing platform.
Figure 8:
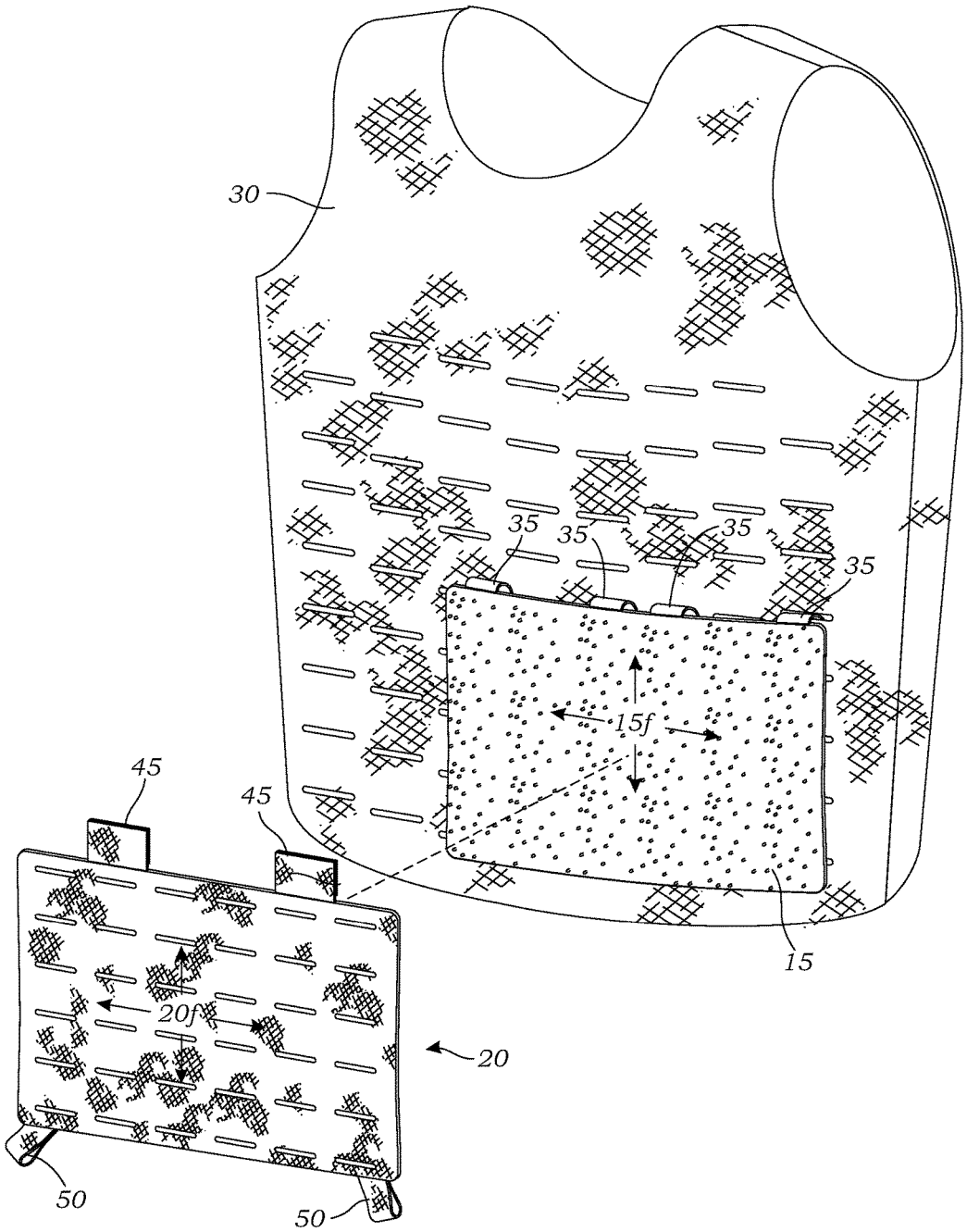
FIG. 8 shows the back panel of FIG. 1 secured to the MOLLE-compatible load-bearing platform of FIG. 7, and the front panel of FIG. 2 positioned to be secured to the back panel.
Figure 9:
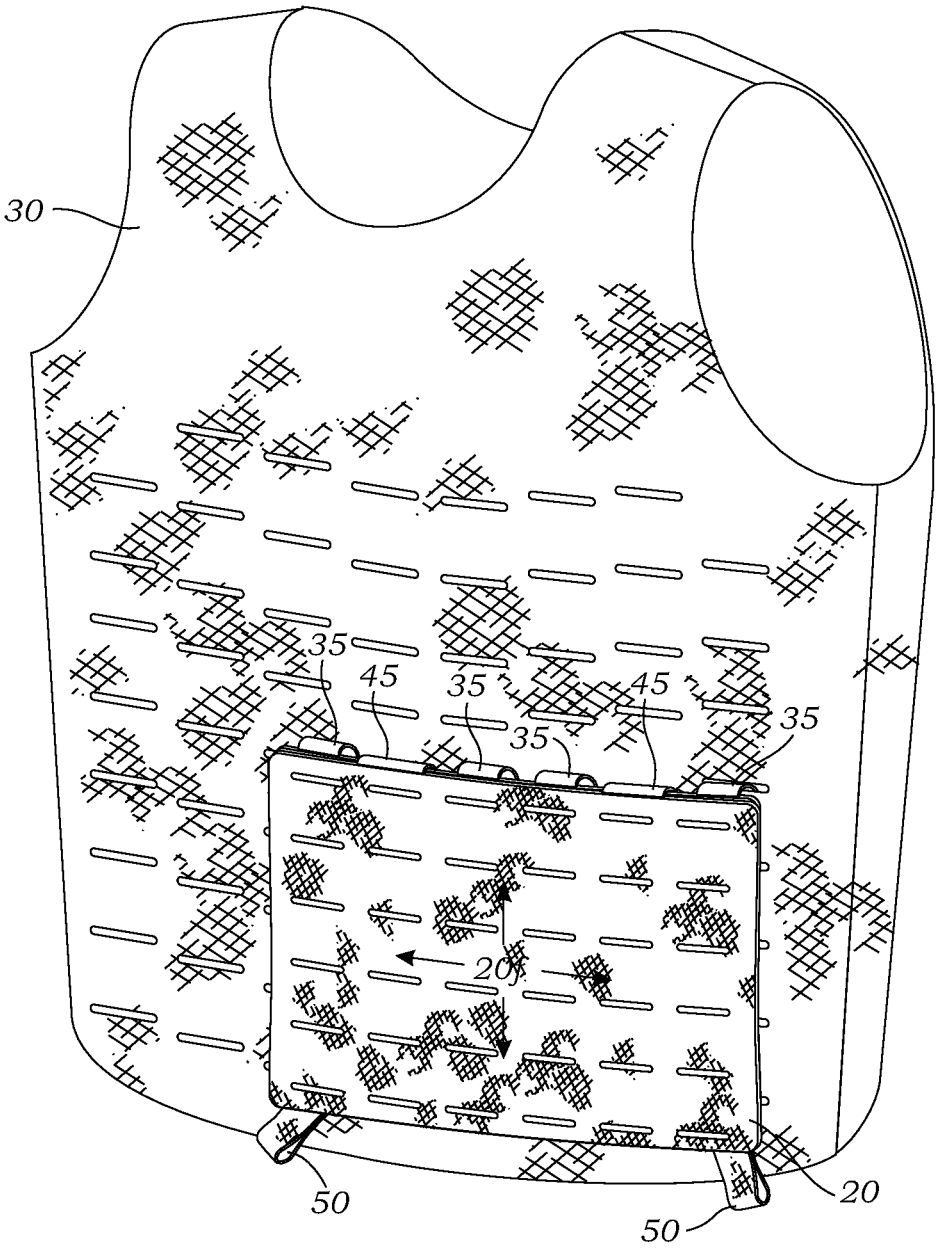
FIG. 9 shows the back panel of FIG. 1 secured to the MOLLE-compatible load-bearing platform of FIG. 7, and the front panel of FIG. 2 secured to the back panel.

Use of the loadout exchange system (5) of the present invention will now be explained. Turning to FIG. 7, there is shown a back panel (20) positioned to be secured to a MOLLE-compatible load-bearing platform (30), which in this example is a tactical vest. The back panel (15) is secured to the platform (30) at a desired location using straps (35) as known in the art of MOLLE. The secured back panel (15) is shown in FIG. 8, which also shows the front panel (20) positioned to be secured to the back panel). The front panel (20) is secured to the back panel (15) as seen in FIG. 9, by placing the hook and loop surface of the back side (20*b*) of the front panel (20) over the hook and loop surface of the front side (15*f*) of the back panel (15) such that the hook and loop surface of the back side (20*b*) of the front panel (20) mates with the hook and loop surface of the front side (15*f*) of the back panel (15) to removably secure the front panel (20) to the back panel (15). Also as shown in FIG. 9, the front panel (20) is further secured to the back panel (15) by folding the tuck tabs (45) over the upper edge of the back panel (15) such that the hook and loop surfaces of the tuck tabs (45) mate with the hook and loop surfaces of the corresponding tab locks (40) to removably secure the tuck tabs (45) to the tab locks (40).

Typically, multiple back panels (15) will be secured to a single MOLLE-compatible load-bearing platform (30) in advance. Likewise, multiple MOLLE pouches (25) with loadouts (10) will be secured to a single front panel (20) in advance, and multiple front panels (20) will be secured to the corresponding multiple back panels (15). A person may thus selectively secure custom-arranged fully-loaded front panels (20) to the platform (30) by attaching the front panels (20) to the back panels (15) as described herein, in a matter of seconds.

Any secured front panel (20) may also be removed and/or replaced with another fully-loaded front panel (20) as needed. For example, if a first person had a vest with a front panel (20) configured for carbine magazines, but a particular mission required handguns and other gear, the carbine-configured front panel (20) could be quickly exchanged for the mission-specific front panel (20) without having to undo and redo any straps. Or the first person may have a supply of his own additional fully-loaded front panels (20) to perform the exchange. Likewise, if a first person with a medical loadout needs to deliver the medical gear to a second person while in the field, the first person can remove the entire fully-loaded front panel (20) and hand or toss it to the second person in a matter of seconds.

Figure 10:
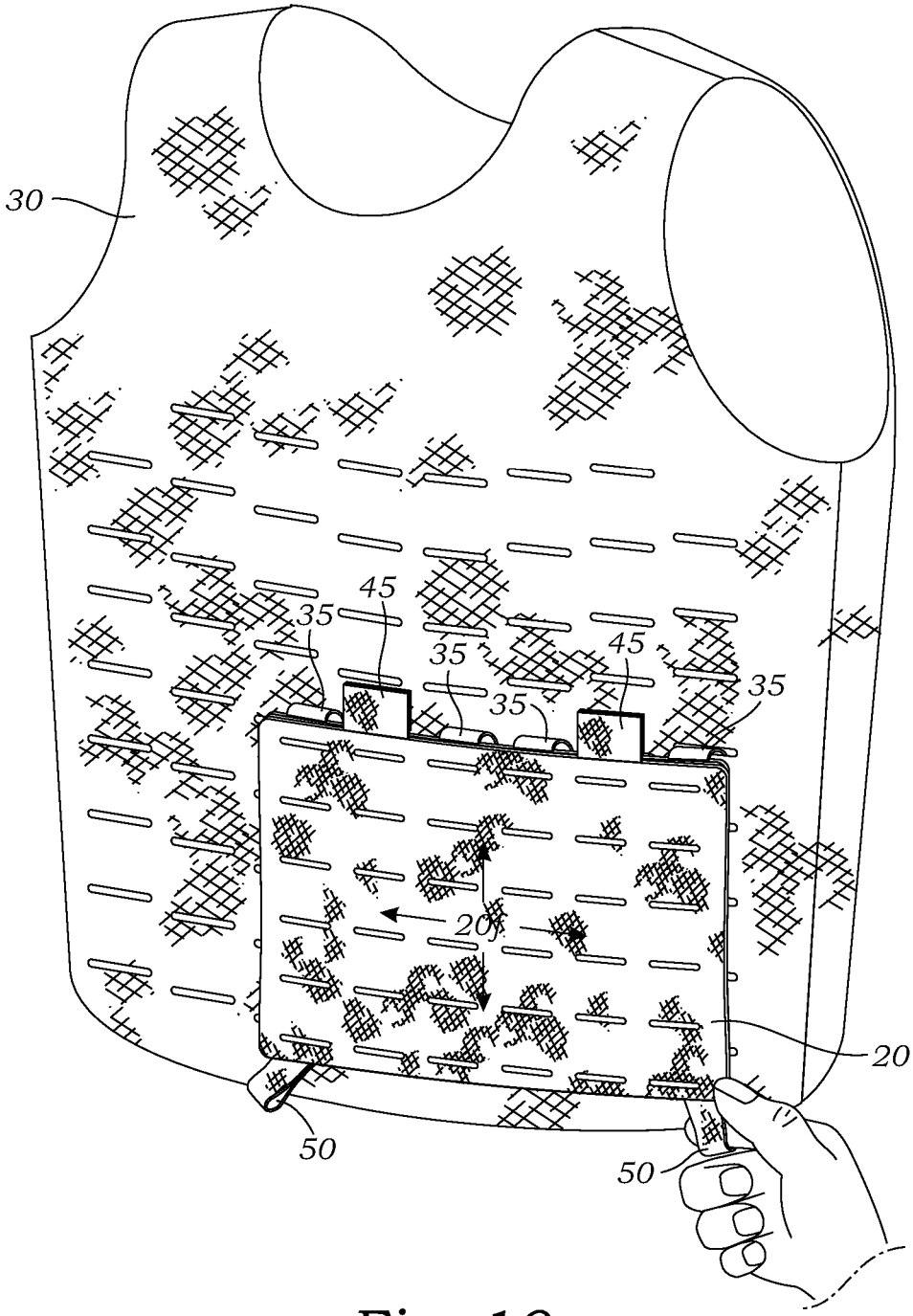
FIG. 10 shows the loadout exchange system of FIG. 9, with the front panel about to be removed from the back panel via a pull tab.

To remove a front panel (20) from a back panel (15), the tuck tabs (45) should be disengaged from the tab locks (40). Doing so is not required, but would likely make removal easier. The tuck tabs (45) are shown disengaged from the tab locks (40) in FIG. 10, which shows the front panel (20) of a loadout exchange system (5) about to be removed from the back panel (15) via a pull tab (50). For illustration purposes, there are no MOLLE pouches (25) attached to the front panel in FIG. 10. Typically there would be, as seen in FIG. 13. FIG. 11 shows the front panel (20) being removed from the back panel (15) by pulling on the pull tab (50) along its longitudinal axis, namely at a diagonal across the front panel (20) from lower right to upper left. Doing so with sufficient force will disengage the complimentary hook and loop surfaces of the back side (20*b*) of the front panel (20) and the front side (15*f*) of the back panel (15), as the front panel (20) is peeled away from the back panel (15).

Methods of the present invention will now be described in further detail. As described earlier, a loadout exchange system (5) of the present invention is installed by attaching the back side (15*b*) of the back panel (15) to a MOLLE-compatible load-bearing platform (30) such as a vest using the straps (35), and MOLLE pouches (25) containing the loadouts (10) are attached to the front side (20*f*) of the front panel (20) using straps of the MOLLE pouches (25). The front panel (20) is secured to the back panel (15) by placing the back side (20*b*) of the front panel (20) over the front side (15*f*) of the back panel (15) such that their complimentary hook and loop surfaces mate, and tuck tabs (45) are folded over the edge of the back panel (15) such that hook and loop surfaces thereon engage complimentary hook and loop surfaces of corresponding tab locks (40) to removably secure the tuck tabs (45) to the tab locks (40).

Figure 15:
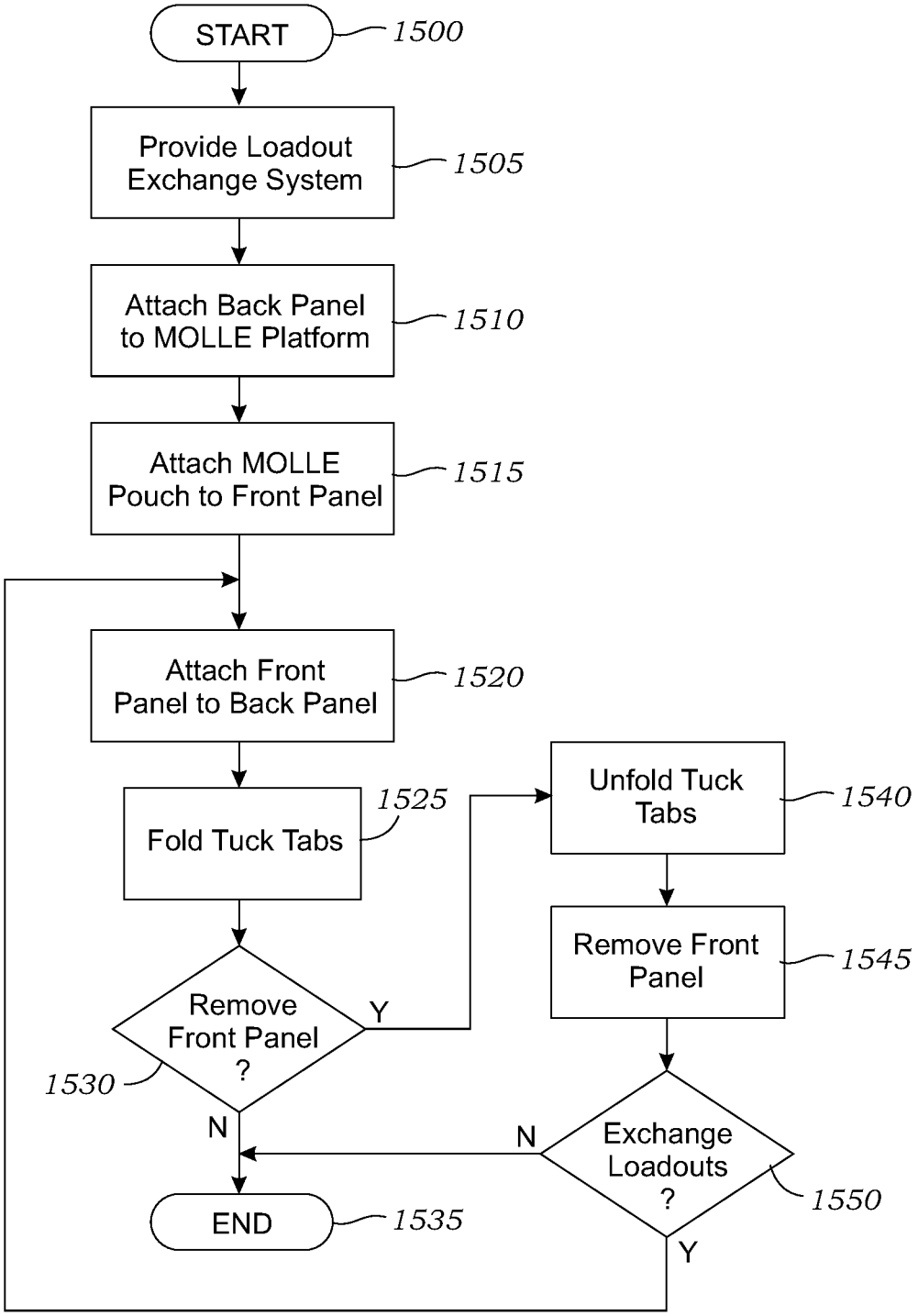
FIG. 15 is a flowchart illustrating a method of the present invention.

Turning to FIG. 15, specific methods will be described. In this example, the method begins at Step 1500, and at Step 1510 a loadout exchange system (5) in accordance with the present invention is provided. This does not require an actual act of "providing," but rather simply the existence of the loadout exchange system (5). The method proceeds to Step 1510 where the back panel (15) is attached to a MOLLE-compatible load-bearing platform (30) as described herein. Once attached, the back panel (15) is generally not removed unless it needs to be replaced, repaired, maintained, or repositioned. At Step 1515, MOLLE-compatible pouches (25) are attached to the front surface (20*f*) of the front panel (20). If performing a method in this sequence, at this point the back panel (15) is secured to the load-bearing platform (30), and MOLLE pouches (25) are secured to the front panel (20). At Step 1520, the front panel (20) is then secured to the back panel (15) by placing the hook and loop surface of the back side (20*b*) of the front panel (20) over the hook and loop surface of the front side (15*f*) of the back panel (15) such that their complimentary hook and loop surfaces mate to removably secure the front panel (20) to the back panel (15). At Step 1525, the front panel (20) is further secured to the back panel (15) by folding tuck tabs (45) over the upper edge of the back panel (15) such that the hook and loop surfaces of the tuck tabs (45) mate with the complimentary hook and loop surfaces of the tab locks (40) to removably secure the tuck tabs (45) to the tab locks (40). That completes the installation of the loadout exchange system (5) on the MOLLE-based load-bearing platform (30), with fully-loaded MOLLE pouches (25) ready for use. Thus, presuming the front panel (20) is not to be removed at that point, the N branch at Step 1530 is followed and the process ends at Step 1535.

However, if the front panel (20) is to be removed, the Y branch at Step 1530 is followed. Then at Step 1540, the tuck tabs (45) are disengaged from the tab locks (40). This is done by unfolding the tuck tabs (45) over the edge of the back panel (15) such that the hook and loop surfaces of the tuck tabs (45) disengage from the complimentary hook and loop surfaces of the tab locks (40) to remove the tuck tabs (45) from the tab locks (40). The front panel (20) is then removed from the back panel (15) by pulling a pull tab (50) in a direction to peel the hook and loop surface of the back side (20*b*) of the front panel (20) away from the complimentary hook and loop surface of the front side (15*f*) of the back panel (15) such that the hook and loop surfaces disengage from each other. If new loadouts (10) are desired, the process loops back to Step 1520, where a new front panel (20) is then secured to the back panel (15). Otherwise, the process ends at Step 1535.

In practice, loadout exchange systems (5) of the present invention will be used as described herein. However, the specific order of the steps is not limited to the order shown in FIG. 15, and all steps are not required. For example, in an emergency, securing the tuck tabs (45) to the tab locks (40) (Step 1525) may not be feasible. Or Step 1525 may be performed after Step 1505 and before Step 1520 in FIG. 15. As another example, Step 1515 (attaching MOLLE pouches (25)) may be performed between Steps 1505 and 1510, or between Steps 1520 and 1525, or after Step 1525.

In another embodiment of the present invention, instead of loadouts (10) being secured to a MOLLE-compatible load-bearing platform (30) by being in MOLLE pouches (25) secured to a front panel (20) which is secured by hook and loop fasteners to a back panel (15) secured to the platform (30), the loadouts (10) are in hook and loop loadout pouches that are secured directly to the back panel (15). In other words, the loadout pouches have a back side comprising a hook and loop surface complimentary to the hook and loop surface on the front side (15*f*) of the back panel (15), and thus can be secured to the front side (15*f*) of the back panel (15) by mating the complimentary hook and loop surfaces. In this embodiment, the hook and loop loadout pouches may also have tuck tabs (45) and/or pull tabs (40) similar to those described herein for the front panel (20).

A loadout exchange system (5) has thus been described, which allows exchange of a loadout (10) in a MOLLE-compatible system without having to un-weave and/or re-weave the pouch straps from/to the load-bearing platform (30), and also that securely supports heavy loads.

What is claimed is:

1. A loadout exchange system comprising:

a back panel comprising a front side with a hook and loop surface, a back side with a MOLLE-compatible surface and a first tab lock with a hook and loop surface, and at least one strap; and a front panel comprising a front side with a MOLLE-compatible surface, a back side with a hook and loop surface, a first pull tab, and a first tuck tab with a hook and loop surface;

wherein the MOLLE-compatible surface of the back side of the back panel is configured for attachment to a MOLLE-compatible load-bearing platform using the at least one strap;

wherein the hook and loop surface of the front side of the back panel is complementary to the hook and loop surface of the back side of the front panel;

wherein the MOLLE-compatible surface of the front side of the front panel is configured to receive at least one strap from a MOLLE-compatible pouch; and wherein the hook and loop surface of the first tuck tab is complimentary to the hook and loop surface of the first tab lock.

2. The loadout exchange system of claim 1, wherein the back side of the back panel comprises a second tab lock with a hook and loop surface, the front panel comprises a second tuck tab with a hook and loop surface, and the hook and loop surface of the second tuck tab is complimentary to the hook and loop surface of the second tab lock.

3. The loadout exchange system of claim 2, wherein the first and second tuck tabs are positioned along an upper edge of the front panel, and the first and second tab locks are positioned along an upper edge of the back panel.

4. The loadout exchange system of claim 1, wherein the front side of the front panel comprises a webless MOLLE-compatible surface, and the back side of the back panel comprises a webbed MOLLE-compatible surface.

5. The loadout exchange system of claim 1, wherein the front panel comprises a second pull tab, and wherein the first pull tab is positioned at a lower right corner of the front panel, and the second pull tab is positioned at a lower left corner of the front panel.

6. The loadout exchange system of claim 1, wherein the hook and loop surface of the back side of the front panel mates with the hook and loop surface of the front side of the back panel to removably secure the front panel to the back panel, and wherein the first tuck tab is folded over an edge of the back panel such that the hook and loop surface of the first tuck tab mates with the hook and loop surface of the first tab lock to removably secure the first tuck tab to the first tab lock.

7. The loadout exchange system of claim 6, wherein the front panel comprises a second pull tab, and wherein the first pull tab is positioned at a lower right corner of the front panel, and the second pull tab is positioned at a lower left corner of the front panel.

8. The loadout exchange system of claim 6, wherein the back panel is attached to a MOLLE-compatible load-bearing platform using the at least one strap.

9. The loadout exchange system of claim 6, wherein the back side of the back panel comprises a second tab lock with a hook and loop surface, the front panel comprises a second tuck tab with a hook and loop surface complimentary to the hook and loop surface of the second tab lock, and the second tuck tab is folded over an edge of the back panel such that the hook and loop surface of the second tuck tab mates with the hook and loop surface of the second tab lock to removably secure the second tuck tab to the second tab lock.

10. The loadout exchange system of claim 9, wherein the back panel is attached to a MOLLE-compatible load-bearing platform using the at least one strap.

11. A method of attaching a loadout exchange system to a MOLLE-compatible load bearing platform comprising;

a) providing a loadout exchange system comprising:

a back panel comprising a front side with a hook and loop surface, a back side with a MOLLE-compatible surface, a first tab lock with a hook and loop surface, a second tab lock with a hook and loop surface, and a at least one strap; and a front panel comprising a front side with a MOLLE-compatible surface, a back side with a hook and loop surface, a first pull tab, a second pull tab, a first tuck tab with a hook and loop surface, and a second tuck tab with a hook and loop surface;

wherein the MOLLE-compatible surface of the back side of the back panel is configured for attachment to a MOLLE-compatible load-bearing platform using the at least one strap;

wherein the hook and loop surface of the front side of the back panel is complimentary to the hook and loop surface of the back side of the front panel;

wherein the MOLLE-compatible surface of the front side of the front panel is configured to receive at least one strap from a MOLLE-compatible pouch;

wherein the hook and loop surface of the first tuck tab is complimentary to the hook and loop surface of the first tab lock; and wherein the hook and loop surface of the second tuck tab is complimentary to the hook and loop surface of the second tab lock;

b) placing the hook and loop surface of the back side of the front panel over the hook and loop surface of the front side of the back panel such that the hook and loop surface of the back side of the front panel mates with the hook and loop surface of the front side of the back panel to removably secure the front panel to the back panel;

c) folding the first tuck tab over an edge of the back panel such that the hook and loop surface of the first tuck tab mates with the hook and loop surface of the first tab lock to removably secure the first tuck tab to the first tab lock;

d) folding the second tuck tab over an edge of the back panel such that the hook and loop surface of the second tuck tab mates with the hook and loop surface of the second tab lock to removably secure the second tuck tab to the second tab lock; and e) attaching the back panel to a MOLLE-compatible load-bearing platform using the at least one strap.

12. The method of claim 11, wherein the first and second tuck tabs are positioned along an upper edge of the front panel, and the first and second tab locks are positioned along an upper edge of the back panel.

13. The method of claim 11, wherein the front side of the front panel comprises a webless MOLLE-compatible surface, and the back side of the back panel comprises a webbed MOLLE-compatible surface.

14. The method of claim 11, wherein steps a) through e) are performed in the order a), e), b), c), d).

15. The method of claim 11, further comprising performing the following steps after performing steps a) through e):

f) unfolding the first tuck tab over the edge of the back panel such that the hook and loop surface of the first tuck tab is disengaged from the hook and loop surface of the first tab lock to remove the first tuck tab from the first tab lock;

g) unfolding the second tuck tab over the edge of the back panel such that the hook and loop surface of the second tuck tab is disengaged from the hook and loop surface of the second tab lock to remove the second tuck tab from the second tab lock; and h) removing the front panel from the back panel by pulling the first pull tab in a direction to peel the hook and loop surface of the back side of the front panel away from the hook and loop surface of the front side of the back panel such that the hook and loop surface of the back side of the front panel disengages from the hook and loop surface of the front side of the back panel.

16. The method of claim 11, further comprising attaching a MOLLE-compatible pouch to the front side of the front panel.

17. The method of claim 16, further comprising performing the following steps after performing steps a) through e), and after attaching the MOLLE-compatible pouch to the front side of the front panel:

f) unfolding the first tuck tab over the edge of the back panel such that the hook and loop surface of the first tuck tab is disengaged from the hook and loop surface of the first tab lock to remove the first tuck tab from the first tab lock;

g) unfolding the second tuck tab over the edge of the back panel such that the hook and loop surface of the second tuck tab is disengaged from the hook and loop surface of the second tab lock to remove the second tuck tab from the second tab lock; and h) removing the front panel from the back panel by pulling the first pull tab in a direction to peel the hook and loop surface of the back side of the front panel away from the hook and loop surface of the front side of the back panel such that the hook and loop surface of the back side of the front panel disengages from the hook and loop surface of the front side of the back panel.

18. A loadout exchange system comprising:

a back panel comprising a front side with a hook and loop surface, a back side with a MOLLE-compatible surface and a first tab lock with a hook and loop surface, and at least one strap; and a hook and loop loadout pouch comprising a front side configured to receive a loadout, a back side with a hook and loop surface, and a first tuck tab with a hook and loop surface;

wherein the MOLLE-compatible surface of the back side of the back panel is configured for attachment to a MOLLE-compatible load-bearing platform using the at least one strap;

wherein the hook and loop surface of the front side of the back panel is complementary to the hook and loop surface of the back side of the hook and loop loadout pouch; and wherein the hook and loop surface of the first tuck tab is complimentary to the hook and loop surface of the first tab lock.

19. The loadout exchange system of claim 18, wherein the hook and loop surface of the back side of the hook and loop loadout pouch mates with the hook and loop surface of the front side of the back panel to removably secure the hook and loop loadout pouch to the back panel, and wherein the first tuck tab is folded over an edge of the back panel such that the hook and loop surface of the first tuck tab mates with the hook and loop surface of the first tab lock to removably secure the first tuck tab to the first tab lock.

20. The loadout exchange system of claim 18, wherein the hook and loop loadout pouch comprises at least one pull tab.

* * * * *